US006626434B2

(12) United States Patent
Tanaka

(10) Patent No.: US 6,626,434 B2
(45) Date of Patent: Sep. 30, 2003

(54) BASEBALL CARD GAME

(75) Inventor: Tokio Tanaka, Tokyo (JP)

(73) Assignee: Konami Corporation, Tokyo (JP)

( * ) Notice: Subject to any disclaimer, the term of this patent is extended or adjusted under 35 U.S.C. 154(b) by 0 days.

(21) Appl. No.: 09/929,159

(22) Filed: Aug. 14, 2001

(65) Prior Publication Data

US 2002/0020966 A1 Feb. 21, 2002

(30) Foreign Application Priority Data

Aug. 17, 2000 (JP) ..... 2000-247160

(51) Int. Cl.[7] ..... A63F 1/00
(52) U.S. Cl. ..... 273/292; 273/236; 273/244
(58) Field of Search ..... 273/292, 244.1, 273/244.2, 236

(56) References Cited

U.S. PATENT DOCUMENTS 669,139 A * 3/1901 Kent ..... 273/244.1
1,064,268 A * 6/1913 Whelan ..... 273/244.1
4,210,335 A * 7/1980 Licciardi ..... 273/238
4,327,914 A * 5/1982 Dowell ..... 273/244.2
4,776,593 A * 10/1988 DiPersio et al. ..... 273/244.2
5,071,136 A * 12/1991 Lott ..... 273/259
5,135,230 A * 8/1992 Denman et al. ..... 273/244
5,186,467 A * 2/1993 Chasin ..... 273/244
5,221,091 A * 6/1993 Gallegos et al. ..... 273/247
5,261,569 A * 11/1993 Sandwell ..... 222/158
5,280,912 A * 1/1994 Porter ..... 273/244
5,322,292 A * 6/1994 Dileva et al. ..... 273/244
5,439,232 A * 8/1995 Pollock ..... 273/294
5,472,191 A * 12/1995 Hendricks ..... 273/244
5,697,844 A * 12/1997 Von Kohorn ..... 463/40
5,762,337 A * 6/1998 Poisson ..... 273/244.2
5,820,127 A * 10/1998 Rodriguez ..... 273/148 A
5,916,024 A * 6/1999 Von Kohorn ..... 463/40
6,012,721 A * 1/2000 Harnish ..... 273/298
6,142,475 A * 11/2000 Hennessey ..... 273/292
6,179,294 B1 * 1/2001 Turnali ..... 273/292
6,209,872 B1 * 4/2001 Caswell ..... 273/244.2
6,402,152 B1 * 6/2002 Kutzik ..... 273/244
6,412,780 B1 * 7/2002 Busch ..... 273/237

* cited by examiner

*Primary Examiner*—Benjamin H. Layno
*Assistant Examiner*—Dolores R. Collins
(74) *Attorney, Agent, or Firm*—Jordan and Hamburg LLP

(57) ABSTRACT

A baseball game which can be advanced while suppressing the number of kinds of cards and using cards evenly. In the case where a player card is disposed on a card disposition area of a batting side, a sum total value of batting force indicated by a batting force indication portion of a batter card and batting force indicated by a batting force indication portion of the player card is derived. Where a player card is disposed on a card disposition area of a fielding side, a sum total value of fielding force indicated by a fielding force indication portion of a pitcher card and fielding force indicated by a fielding force indication portion of the player card is derived. Subsequently, a game is advanced according to a game advance content indicated in a batting table of the batter card, for each of values obtained by a comparison, for example a difference, between a sum total value of the fielding side and a sum total value of the batting side.

13 Claims, 8 Drawing Sheets

FIG. 2

13 BATTING TABLE

| | |
|---|---|
| -4 | DOUBLE PLAY |
| -3 | STRIKE-OUT |
| -2 | STRIKE-OUT |
| -1 | OUT F |
| 0 | OUT F |
| 1 | H |
| 2 | H |
| 3 | 2B |
| 4 | HR |

FIG. 4

| PLAYER NAME | EFFECT NAME | EFFECT |
|---|---|---|
| U | SLIDER | WHEN THE PLAYER PITCHES, PRESENTING A CARD OF RANK B FROM HAND INCREASES THE FIELDING FORCE BY ONE. |
| A | STRONG AGAINST LEFT-HANDED PITCHER | WHEN OPPOSITE PITCHER IS LEFT-HANDED, THE PLAYER BEING AT BAT INCREASES BATTING FORCE BY ONE. |
| ⋮ | ⋮ | ⋮ |

FIG.5

| OPERATIONAL CARD NAME | CONTENT OF OPERATION |
|---|---|
| HIT CARD | By turning this card sideways, the batting force can be increased by one and a sacrifice hit can be made a hit. |
| HOME RUN CARD | By turning this card sideways, the batting force is increased by three with butting aiming at a home run. However, each of h, 2b and 3b becomes out f. |
| RUN BATTED IN CARD | By turning this card sideways, the batting force is increased by two. In the case where there is a runner, the batting force is increased by three. |
| BUNT CARD | By turning this card sideways, a strike-out and a out f can be made a sacrifice hit. However, each of 2b, 3b and hr becomes h (safety bunt). |
| WIN CARD | By turning this card sideways, the fielding force is increased by two. When there are no runners, the fielding force is increased by three. |
| WIN PERCENTAGE CARD | By turning this card sideways, the fielding force is increased by one. Furthermore, "poor batting" can be made a double play. |
| EARNED-RUN AVERAGE CARD | By turning this card sideways, the fielding force is increased by two. When there is a runner, the fielding force is increased by three. |
| BASE STEALING CARD | By opening this card, a first base runner can be advanced to the second base. |
| BASE STEALING PREVENTION CARD | By opening this card when the base stealing card is used, the runner who has stolen the base can be made out. |
| FINE BASE RUNNING CARD | By opening this card when h, 2b or 3b is made, a selected runner or butter can be advanced one base. |
| FINE BALL RETURNING CARD | By opening this card when the fine base running card is used, a runner selected by the opposite game player can be made out. |
| MANAGER CARD | While this card is open, players participating in a game of the baseball team are increased by two in the batting force and fielding force during only the inning. |
| ERROR CARD | By opening this card when a double play, poor butting, infield f, a sacrifice hit or an outfield f is made, it can be necessarily made a hit. |
| HIT BY ERROR PITCH CARD | By opening this card when the numerical value of the batting side is equal to that of the fielding side, the butter can advance to the first base. |
| FINE FIELDING PLAY CARD | By opening this card when hr is made, it can be made outfield f. |
| CHEERING CARD | By opening this card, it is possible to discard an unnecessary card from the hand, and supplement the hand with cards from the deck. |
| MONTHLY MVP CARD (PITCHER) | By turning this card sideways, the fielding force is increased by three. |
| MONTHLY MVP CARD (FIELDER) | By turning this card sideways, the batting force is increased by three. |
| INFIELD SHIFT CARD | While this card is open, a sacrifice hit can be made poor butting during only the inning. |
| OUTFIELD SHIFT CARD | While this card is open, the fine base running card and the home run card can be made invalid during only the inning. |

FIG. 6

| | |
|---|---|
| TURN TYPE | HIT, HOME RUN, RUN BATTED IN, BUNT, WIN, PERCENTAGE OF WINS, EARNED-RUN AVERAGE, OR MONTHLY MVP CARD<br>→ WHEN EXECUTING THE OPERATION, PRESENT A PLAYER CARD FROM THE HAND, TURN IT SIDEWAYS, AND USE IT. |
| OPEN TYPE | BASE STEALING, MANAGER, CHEERING, INFIELD SHIFT, OR OUTFIELD SHIFT CARD<br>→ WHEN EXECUTING THE OPERATION, OPEN THE CARD FACE UP AT THE TIME OF OPERATIONAL TIME AND USE IT. |
| TRIGGER TYPE | BASE STEALING PREVENTION, FINE BASE RUNNING, FINE BALL RETURNING, HIT BY ERROR PITCH, OR FINE FIELDING PLAY CARD<br>WHEN A SITUATION WRITTEN ON THE OPERATIONAL CARD HAS OCCURRED, OPEN THE CARD FACE UP AND USE IT. |

BASEBALL CARD GAME

BACKGROUND OF THE INVENTION

1. Field of the Invention

The present invention relates to a baseball game toy for playing a baseball card game, and a card group for baseball card game.

2. Description of the Related Art

Heretofore, various baseball card games have been proposed. For example, there has been provided a baseball card game in which a player card group and a play card group are prepared, and the player card group is disposed in specified positions of a sheet. One's own side and the opposite party side present mutually play cards, the advance or out of the batting side is determined to carry out the baseball card game. In another proposed baseball card game, bat first and bat last are determined by casting a dice, a pip indicated by the dice cast by the bat first side and batting force of a card disposed on a sheet are added together. According to game advance contents corresponding to an addition result range indicated on a pitcher card of the defensive side, the baseball card game is conducted.

In these conventional baseball card games, however, roles are assigned to cards definitely. Therefore, cards are not used evenly. Furthermore, since the game advance contents are determined by using a dice or the like other than cards, the game advance cannot be enjoyed by using only cards.

SUMMARY OF THE INVENTION

In order to solve such problems of the conventional technique, the present invention has been made. An object of the present invention is to provide such a baseball game toy and a card group for baseball card game that the number of kinds of cards is suppressed to the utmost and the baseball game can be advanced using cards evenly.

In order to achieve the object, a baseball game toy for playing a baseball card game according to one aspect of the present invention includes: player cards; and a pair of field sheets for disposing the player cards thereon. Each of the player cards includes: a batting force indication portion for giving a sum total value of a batting side when each of the player cards is disposed on a card disposition area of a batting side field, in conjunction with a batter card disposed on a pitcher and batter area of the batting side field, the batter card being a kind of the player cards; a fielding force indication portion for giving a sum total value of a fielding side when each of the player cards is disposed on a card disposition area of a fielding side field, in conjunction with a pitcher card disposed on a pitcher and batter area of the fielding side field, the pitcher card being a kind of the player cards; and a game advance content indication portion for indicating a game advance content for each of values derived from the sum total value of the batting side and the sum total value of the fielding side.

According to the first aspect of the present invention, in the case where a player card is disposed on the card disposition area of the batting side, a sum total value of batting force indicated by a batting force indication portion of a batter card and batting force indicated by the batting force indication portion of the player card is derived. On the other hand, in the case where a player card is disposed on the card disposition area of the fielding side, a sum total value of fielding force indicated by a fielding force indication portion of a pitcher card and fielding force indicated by a fielding force indication portion of the player card is derived. Subsequently, a game is advanced according to a game advance content indicated in a game advance content indication portion of the batter card, for each of subtraction result values obtained by subtracting the sum total value of the fielding side from the sum total value of the batting side. The baseball card game can be thus played. Therefore, the game can be advanced while suppressing the number of kinds of cards to the utmost and using cards evenly.

Furthermore, the game advance content indication portion may indicate a game advance content for each of subtraction result values derived by subtracting the sum total value of the fielding side from the sum total value of the batting side. In addition, a pair of field sheets may be formed so as to be opposed to each other and brought into contact with each other.

Furthermore, cards each further including a special effect indication portion for indicating a special effect demonstrated in a baseball card game may be included in the player cards. Each of the player cards serving as the pitcher cards may include a disposition time indication portion for indicating suitable disposition time of the card. In addition, each of player cards may further include an image indication portion for indicating a photograph of a professional baseball player, and a result indication portion for indicating actual past results of the professional baseball player. And the baseball game toy may include operational cards besides the player cards, and each of the operational cards may include an operational content indication portion which indicates an operational content for implementing an advantageous baseball game state including an increase of fielding force or batting force.

According to another aspect of the present invention, there are provided cards for a baseball card game, the baseball card game being played by playing a baseball game while changing a fielding side and a batting side a predetermined number of times, base advance or an out of a batting side being determined in the baseball game by comparing a sum total value of the fielding side with a sum total value of the batting side, the sum total value of the fielding side being a sum total of fielding force of a pitcher card disposed in a first position of a fielding side field and fielding force of a fielding side card disposed in a second position of the fielding side field from a hand of the fielding side, the hand of the fielding side being successively supplemented so as to have a predetermined number of cards by conducting selection from a predetermined number of deck cards piled in a deck position of the fielding side field, the sum total value of the batting side being a sum total of batting force of a batter card disposed in a first position of a batting side field and batting force of a batting side card disposed in a second position of the batting side field from a hand of the batting side, the hand of the batting side being successively supplemented so as to have a predetermined number of cards by conducting selection from a predetermined number of deck cards piled in a deck position of the batting side field, wherein each of the pitcher card and the fielding side card includes a fielding force indication portion for deriving the sum total value of the fielding side, and each of the batter card and the batting side card includes a batting force indication portion for deriving the sum total value of the batting side.

According to the aspect of the present invention, a sum total value of the fielding side can be obtained from fielding force indicated by a fielding force indication portion formed on a pitcher card and fielding force indicated by a fielding force indication portion formed on a fielding side card on the other hand, a sum total value of the batting side can be obtained from batting force indicated by a batting force indication portion formed on a batter card and batting force indicated by a batting force indication portion formed on a batting side card. By comparing the sum total values, the base advance or an out of the batting side is determined and the baseball card game can be played. Therefore, the game advance content can be determined without using a dice or the like. In addition, the game can be advanced by using cards evenly.

Furthermore, each of the pitcher card and the fielding side card may include a batting force indication portion for deriving a sum total value of the batting side in the case of change between the batting side and the fielding side, and each of the batter card and the batting side card may include a fielding force indication portion for deriving a sum total value of the fielding side in the case of change between the batting side and the fielding side. Furthermore, cards each further including a special effect indication portion for indicating a special effect demonstrated in the baseball card game may be included in the cards.

Furthermore, each of the cards may include a game advance content indication portion which indicates a game advance content for each of subtraction result values derived by subtracting the sum total value of the fielding side from the sum total value of the batting side. Furthermore, the cards may include operational cards each including an operational content indication portion which indicates an operational content for implementing an advantageous baseball game state including an increase of fielding force or batting force. And each of the pitcher cards may include a disposition time indication portion for indicating suitable disposition time of the card.

BRIEF DESCRIPTION OF THE DRAWINGS

FIG. 2 is an explanatory diagram of a batting table;

FIG. 4 is an explanatory diagram of a special effect;

FIG. 5 is an explanatory diagram of kinds of operational cards;

FIG. 6 is an explanatory diagram of a method of using operational cards;

DESCRIPTION OF THE PREFERRED EMBODIMENTS

Figure 1:
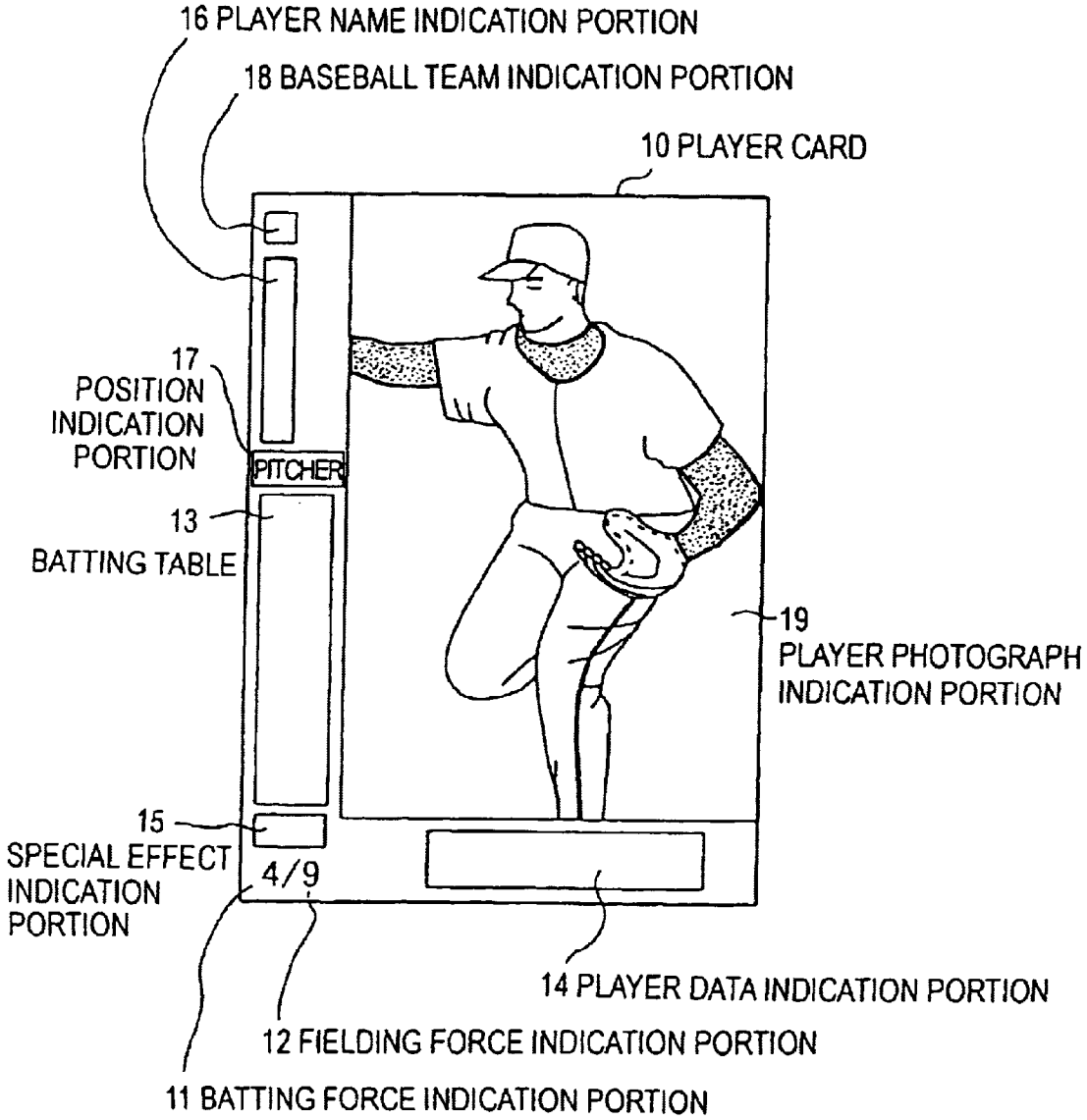
FIG. 1 is an explanatory view of a player card.

Hereafter, embodiments of the present invention will be described by referring to the drawings.

(Card Configuration)

As cards used in this game, there are "player cards" and "operational cards".

In the player cards, there are "pitcher cards" and"fielder cards". As described later, a predetermined number of cards, such as at least 50 cards, selected from among them are disposed in piles as a deck on each field sheet.

(A) Player Cards

FIG. 1 is an explanatory view of a configuration of a player card 10. Each player card 10 includes a baseball team indication portion 18 for indicating a mark of a baseball team in order to indicate the baseball team the player belongs to, a player name indication portion 16 for indicating a name of the player, a position indication portion 17 for indicating a position, a batting table 13 (a game advance content indication portion) described later, a batting force indication portion 11 for indicating a batting force so that a total value of the batting side may be derived therefrom and a batter card (a kind of a player card) disposed in a pitcher and batter area of a field of the batting side described later, a fielding force indication portion 12 for indicating a fielding force so that a total value of the fielding side may be derived therefrom and a pitcher card (a kind of a player card) disposed in a pitcher and batter area of a field of the fielding side described later, a player photograph indication portion 19 for indicating a photograph of a professional baseball player having a player name indicated on the player name indication portion 16, and a player data indication portion 14 for indicating results of the past (for example, of the past three years) of the professional baseball player. By the way, the same pattern is indicated on the reverse side of each plater card so that a distinction may not be made when cards are disposed with front sides down. As for rank indication, a representation such as "S" or "A" is indicated on the left side of the batting force indication portion 11.

Therefore, it is possible to play a game while enjoying seeing a photograph of a professional baseball player and past results of the professional baseball player. On some player cards, there is formed a special effect indication portion 15 for indicating a special effect to be demonstrated in the baseball card game. On the player card 10 shown in FIG. 1, the special effect indication portion 15 is formed.

Furthermore, on the pitcher card, there is formed a disposition time indication portion (not illustrated) indicating a suitable disposition time. To be concrete, "starter", "reliever", and "closer" are indicated. In the case of "starter", the pitcher basically cannot take the plate after the game is underway. If the "starter" pitcher takes the plate in the second inning or later,i then the fielding force is decreased by "2" per inning in an inning subsequent to taking the plate and the game is played. In the case of "reliever", the pitcher can be disposed anytime in the second inning or later. In the case of "closer", the pitcher basically can take the plate only in the eighth inning or later. If a closer pitcher is used as a starter or made to take the plate in the second to seventh inning as a reliever pitcher, then the fielding force is decreased by "2" per inning in an inning subsequent to taking the plate and the game is played. Since the disposition time indication is thus formed, game players can enjoy a play by taking the disposition time into consideration.

FIG. 2 is an explanatory diagram of the batting table 13. This table indicates whether a result at bat should be advanced or out, in association with each subtraction result value obtained by subtracting a sum total of fielding forces of the fielding side from a sum total value of batting forces of the batting side. In an example shown in FIG. 2, the result becomes "out" with an outfield fly in the case where the subtraction value is "0" and "hit" in the case where the subtraction value is "+1".

"HR" represents a home run and the, batter can advance to the home base. "3B" represents a three-bagger and the batter can advance to the third base. "2B" represents a two-bagger and the batter can advance to the second base. "H" represents a hit and the batter can advance to the first base. "Sacrifice" represents a sacrifice hit. If a sacrifice hit is made at the time of no outs or one out, then the batter is out but every runner can advance by one base. If a sacrifice hit is made at the time of two outs, then runners cannot advance because of a three-out change. "Out F" represents an outfield fly. If an outfield fly is made at the time of no outs or one out, the batter is out but a three base runner can advance to the home. If an outfield fly is made at the time of two outs, then a three home runner cannot advance to the home because of a three-out change. Furthermore, upon "three strikes", the batter is struck out. "In F" represents an infield fly, and the batter is out. "Poor batting" represents an infield grounder and the batter is out. Upon a "double play" when there is a runner on a base, the batter and the runner are out and two outs can be obtained at one time. Upon a "double play" when there are a plurality of runners on bases, the most advancing runner is out. For example, if a double play is conducted when there are runners on the first base and the second base, then the batter and the runner on the second base are out, and the runner on the first base can advance to the second base (If a double play is conducted when there are no runners on bases, however, only the batter is out and the number of outs increased by one). However, depending upon contents of an operational card or a special effect described later, poor hitting becomes a double play or a sacrifice hit becomes a hit in some cases.

The batting table 13 might differ depending upon individual player cards. For example, if the subtraction result value is "0", then a three-strike out is caused in most cases. In the case of a swift-footed player, however, a hit is made in some cases. By the way, if the subtraction result value is "+5" or more, a home run is made. If the subtraction result value is "−5" or less, a double play is made.

An effect in the case where the special effect indication portion 15 is formed will now be described. A special effect represents individuality or ability of a player. If a player card having the special effect indication portion 15 formed thereon is used, then the batting force or the fielding force increases or the game development is affected. If conditions indicated on the special effect indication portion 15 are satisfied, the game is played so as to demonstrate the effect.

FIG. 4 shows an example of the special effect. In the case where the player name is "U" and the effect name is "slider", the fielding force increases by one if a card of rank B is taken out from hands(described later) when this player pitches. Furthermore, in the case where the player name is "A" and the effect name is "strong against a left-handed pitcher", the batting field increases by one if this player is at bat when the opposite pitcher is left-handed. Furthermore, an operational card described later and the special effect can be used altogether. For example, suppose that the opposite pitcher is left-handed, and that a player "A" having a batting force 7 (see FIG. 4) is at bat. If at that time a hit card is used, the batting force of the player "A" becomes "7 (original batting force)+1 (effect of the hit card)+1 (special effect)=9". By thus playing while considering the effect indicated on the special effect indication portion 15, the baseball card game can be played with more enjoyment.

(B) Operational Card

Figure 3:
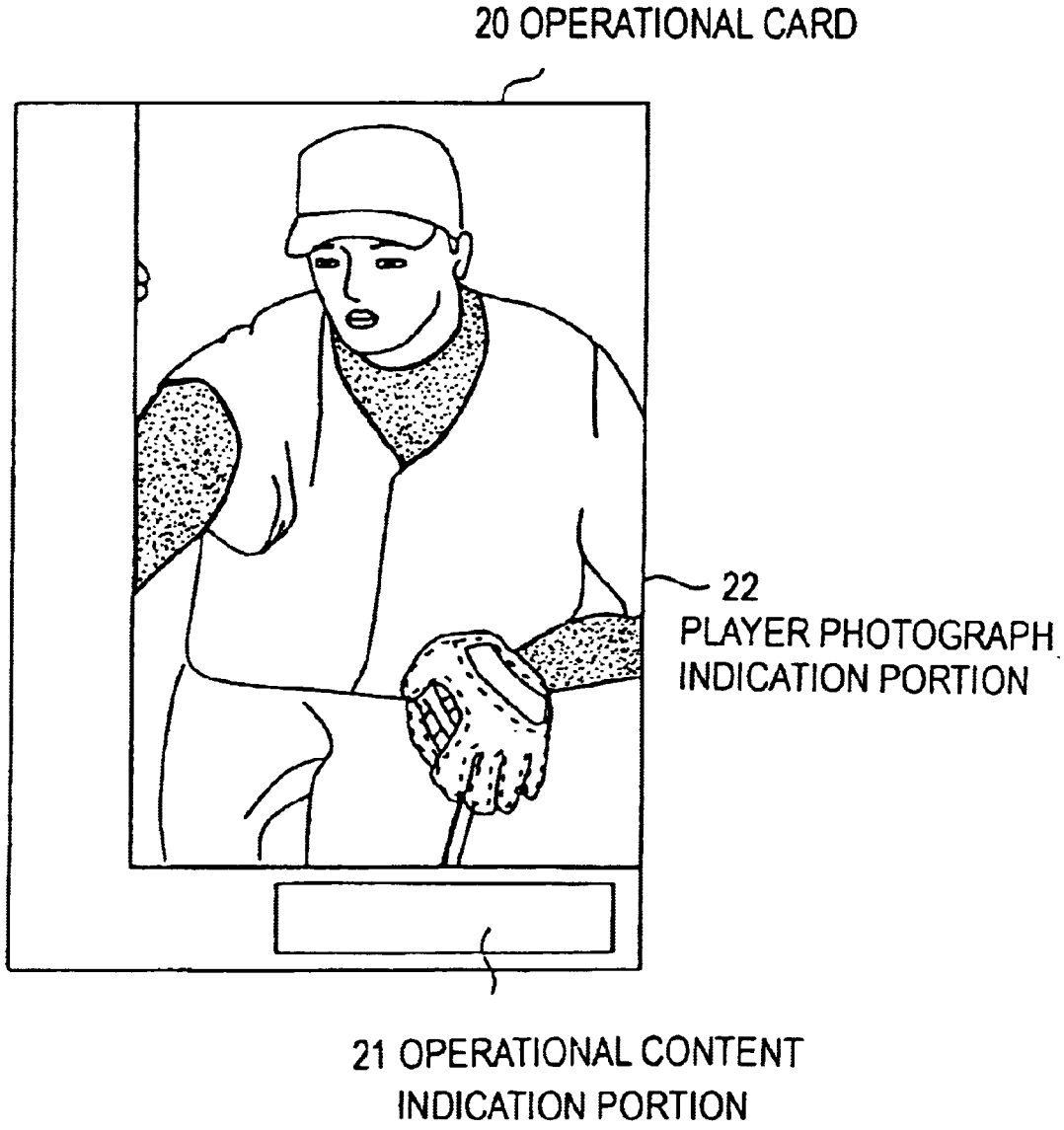
FIG. 3 is an explanatory view of an operational card.

FIG. 3 is an explanatory view showing a configuration of an operational card 20. This operational card 20 includes an operational content indication portion 21 which indicates operational contents for, implementing a baseball game state including an increase of the fielding force or the batting force, and a player photograph indication portion 22 which indicates a photograph of a professional baseball player. By the way, a pattern similar to that of the reverse side of the player card 10 is indicated on the reverse side of the operational card 20 so that a distinction may not be made between cards when cards are disposed with front sides down. FIG. 5 is an explanatory diagram showing operational card names and their operational contents in association. Such various operational cards are provided.

The operational cards 20 are disposed in an operational card disposition area at operational time with front sides down as described later. Depending on the kind thereof, how to execute an operation differs. FIG. 6 is an explanatory diagram showing this. In the case where an operation is executed in "turn type (hit, home run, run batted in, bunt, win, percentage of wins, earned-run average, or monthly MVP card) 11, a player card is taken out from hands and thereafter the card is used with its face turned sideways. In the case where an operation is executed in "open type (base stealing, manager, cheering, infield shift, or outfield shift card)", a card is used with its face upward at the operational time. Furthermore, in the case of "trigger type (base stealing prevention, fine base running, fine ball returning, hit by error pitch, or fine fielding play card)", a card is opened with its face turned upward when a situation indicated on the operational card has occurred.

This operational card 20 is not always to be used when it is disposed on the field, but its face can be turned downward until the time when it should be used is reached. Or it may be kept unused and then discarded into a dumping place at an operational time of a change between the batting and fielding. Unless a special order is indicated, the operational card 20 must immediately be discarded after the operation is executed (In some operational cards, however, the effect of the operation continues during the inning in which the operational card has been used.). Furthermore, if an operation is executed, but the effect of the operational card cannot be used because of a base on balls, a strike-out, or the like, then the operational card becomes invalid, and the operational card must be discarded into the dumping place.

By playing using such an operational card 20, therefore, various operations can be executed. As a result, it becomes possible to play the baseball card game with more enjoyment.

(Field Configuration)

Figure 7:
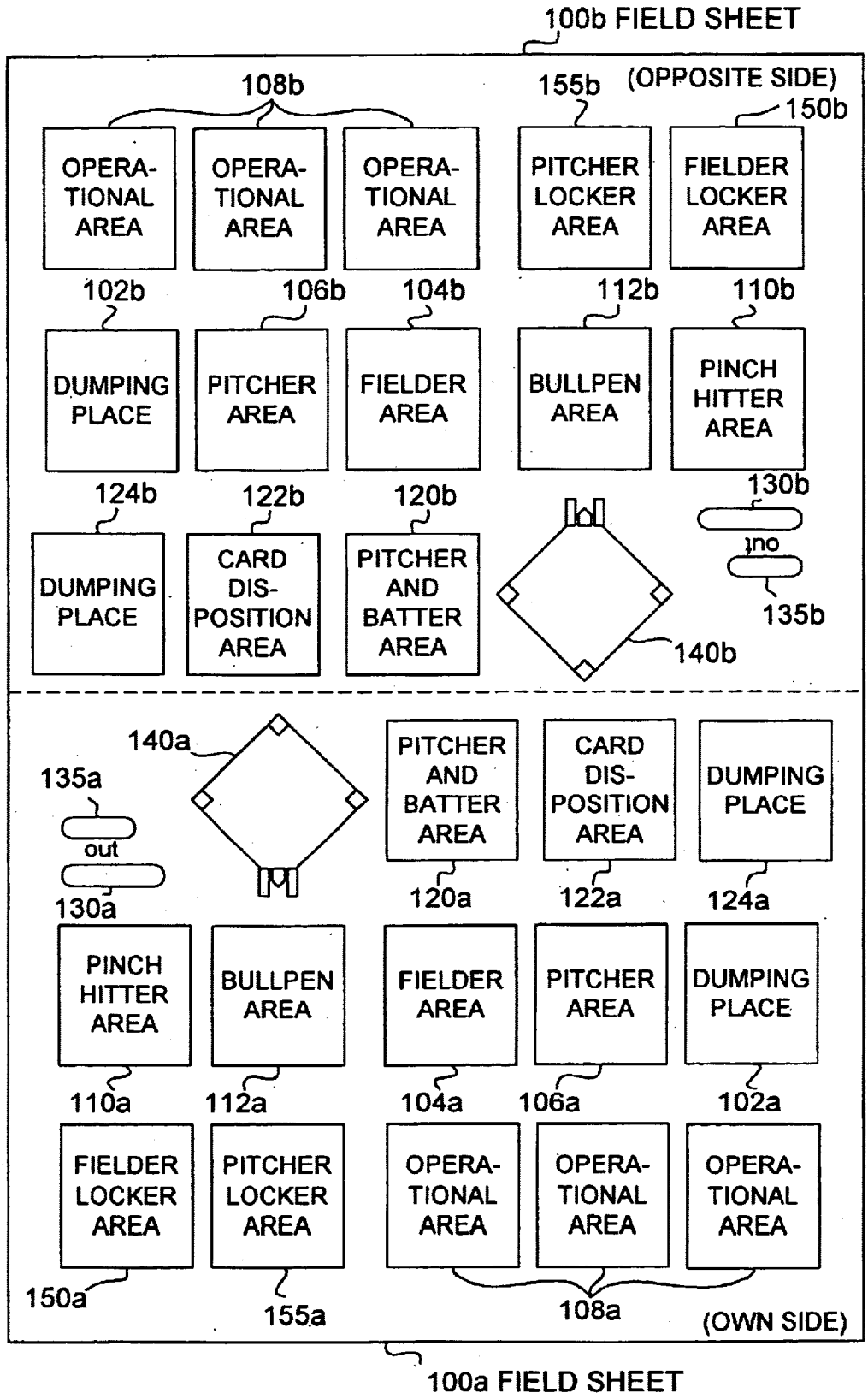
FIG. 7 is an explanatory view of fields.

FIG. 7 is an explanatory view of a field configuration. A field can be formed by making a pair of own and opposite field sheets 100*a* and 100*b* opposed to each other and in contact with each other. A field can be formed simply by such a configuration. Furthermore, since the field is separated by a broken line of FIG. 7 in the transverse direction, it can be carried conveniently.

In the field sheet 100*a* and the field sheet 100*b*, the same indication is formed. Therefore, only the field sheet 100, aside will be described. On the bottom side of the field sheet 100*a*, operational areas 108*a* are formed so that up to three operational cards may be disposed therein. Furthermore, on the right-hand side of the field sheet 100*a*, there are formed a dumping place 124*a* for piling up cards finished in use, and a deck 102*a* for disposing 50 previously selected cards therein so as to form a pile.

On the central part of the field sheet 100*a*, there are formed a fielder area 104*a* for disposing player cards serving as starting members therein, and a pitcher area 106*a* for disposing selected pitcher cards therein. On the top side of the field sheet 100*a*, there are formed a pitcher and batter area 120*a* for disposing a batter card in the case of batting therein, or disposing a pitcher card in the case of fielding therein, and a card disposition area 122*a* for disposing therein a player card selected from a "hand", which is comprised of cards held by a hand, that are successively supplemented so as to be six in number from cards disposed in the deck 102*a*.

Furthermore, on the left center portion of the field sheet 100*a*, there are formed a pinch hitter area 110*a* for disposing a pinch hitter card therein, and a bullpen area 112*a* for disposing pitcher cards of benchwarmers therein. On the left top portion of the field sheet 100*a*, there is formed a baseball field 140*a* comprised of a home base, first to third bases, and white lines connecting them. On the left under side thereof, an out count gauge 130*a* is formed. In the game advance, runner pieces 131 regarded as runners are used. The runner pieces are moved on the bases to advance according to the game advance. If the runner is out, the piece is placed on the out count gauge 130*a*.

Above the out count gauge 130*a* (130*b*), there is formed a stamina gauge 135*a* (135*b*) which indicates the stamina of the pitcher. In the case where the basic fielding force of the pitcher falls, a piece is placed in a gauge of a lowered value to indicate a numerical value of the basic fielding force of the current pitcher on the stamina gage 135*a*.

In addition, a fielder locker area 150*a* (150*b*) is formed below the pinch hitter area 110*a* (110*b*) of the field sheet 100*a* (100*b*). A pitcher locker area 155*a* (155*b*) is formed below the bullpen area 112*a* (112*b*). In the locker areas, changed player cards are disposed. For example, in the case where a starting pitcher has left the plate, the starting pitcher card is placed on the pitcher locker area 155*a* (155*b*).

(Game Contents)

(A) Game Preparation

Actual game contents will now be described. Prior thereto, the game preparation will now be described. It is now assumed that each of the own side and the opposite side has 48 player cards and 18 operational cards, i.e., a total of 66 cards. Each of the game players selects 50 cards from among them and disposes the 50 cards on the deck (102*a*, 102*b*), and selects 16 cards to enter the bench.

The bench means a combination of player cards. This becomes a team to be used in the game. The bench is comprised of 16 player cards. As starting members, one pitcher card and eight fielder cards (nine fielder cards in the case of DH system) are necessarily put on the bench. Seven remaining cards are benchwarmers. The starting members are comprised of nine members, i.e., one pitcher, one catcher, four infielders, and three outfielders. Therefore, nine player cards are determined by taking positions indicated on the position indication portions 17 of respective player cards. In the case of the DH system, a total of ten members are determined to be starting members, and the designated hitter may assume any position.

After the selection of the starting members, the batting order ranging from the first to ninth is determined and the starting members are disposed on the fielder areas 104*a* and 104*b*. Furthermore, selected pitcher cards are disposed on the pitcher areas 106*a* and 106*b*. Pitcher cards of benchwarmers are disposed on the bullpen areas 112*a* and 112*b*. Player cards of benchwarmer hitters are disposed on the pinch hitter areas 110*a* and 110*b*.

(B) Game Advance

Figure 8:
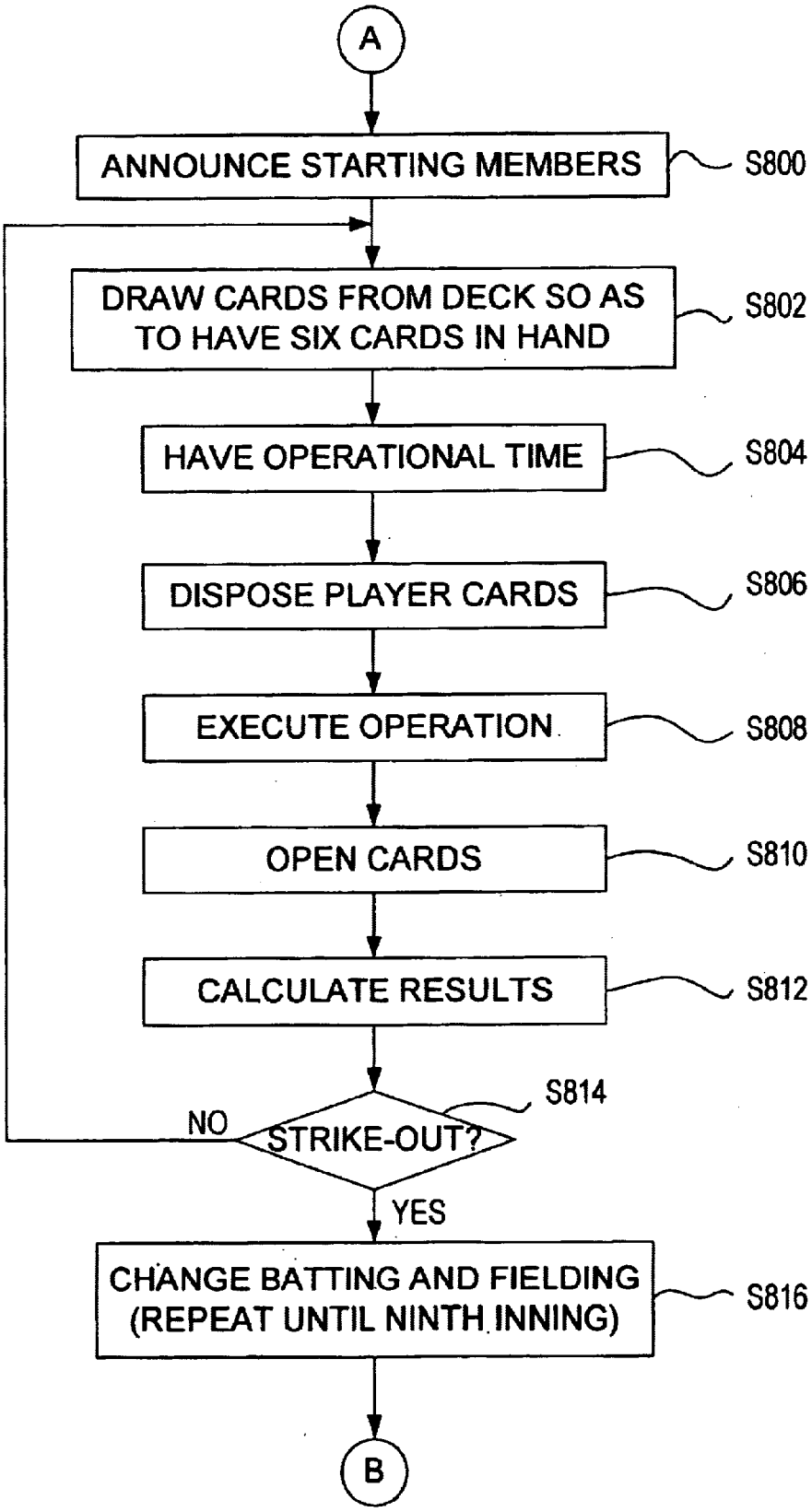
FIG. 8 is a flowchart showing an advance of a card game.

Batting first and batting last are determined, and then starting members are announced (step S800 in FIG. 8). Namely, each of opposite sides is notified of first to eighth hitters (to ninth hitters in the case of the DH system) and a starting pitcher. In the ensuing description, it is assumed that the own side goes to batting first and the opposite side goes to batting last. The fielding side (opposite side) disposes a starting pitcher card face up on the pitcher and batter area 120*b*.

Subsequently, each side draws six cards successively from the deck and makes them a first hand to be used for the game (step S802). Thereafter, every time the batter is changed, a card is supplemented from the deck so that a hand always becomes six cards. When operational cards are included in the hand, an operational card to be used is disposed on the operational area 108a or 108b (step S804). This is called "operational time", and up to three operational cards from the hand can be disposed on the operational area 108*a* or 108*b*. As for the base stealing card, the cheering card and so on among the operational cards, operation can be executed without following the procedure hereafter described. Only at the time of operational time when batting and fielding are changed, unnecessary operational cards can be discarded in the dumping places 124*a* and 124*b*. Unnecessary ones among operational cards disposed on the operational areas 108*a* and 108*b* can be disposed face up on the dumping places 124*a* and 124*b*, and thus operational cards included in the hand can be disposed on the operational areas 108*a* and 108*b*.

Next, the fielding side presents one player card from the hand, and disposes it face down on the card disposition area 122*b*. On the other hand, the batting side (the own side) also presents one player card from the hand, and disposes it face down on the card disposition area 122*a* (step S806).

Next, the fielding side determines whether the operational card should be executed against the batter. In the case where the operation is to be executed, the fielding side turns the operational card sideways, and declares operation execution (step S808). After the determination on the fielding side, the batting side determines whether the operational card should be executed against the opposite pitcher. Once operation execution is determined, it cannot be canceled. Up to three operational cards can be used simultaneously. By using a plurality of operational cards simultaneously, the operational effect can also be increased (which is called combination).

If an operational card is presented instead of a player card when the player has to present a player card from the hand, then it is regarded as evasion from the fight. If the batting side presents an operational card instead of a player card, then it is regarded as a strike-out. If the fielding side presents an operational card instead of a player card, it is regarded as a base on balls.

Subsequently, both the fielding side and the batting side turn faces of player cards disposed on the card disposition areas 122*a* and 122*b* up (step S810). Mutual fielding force and batting force are thus derived (step S812). The sum total of the fielding force indicated on the fielding force indication portion 12 of the pitcher card and the fielding force indicated on the fielding force indication portion 12 of the player card disposed on the card disposition area 122*b* becomes the sum total of the fielding side. On the other hand, the sum total of the batting force indicated on the batting force indication portion 11 of the batter card and the fielding force indicated on the batting force indication portion 11 of the player card disposed on the card disposition area 122*a* becomes the sum total of the batting side.

A subtraction result value is obtained by subtracting the sum total value of the fielding force from the sum total value of the batting force. Depending on the value, the game is advanced according to the contents of the game indicated on the batting table 13 of the batting card. However, in the case where an operation has been executed with an operational card turned sideways, the operational card is placed face up and a numerical value is increased or decreased according to the indicated contents of the operation. Furthermore, it is necessary to increase or decrease the numerical value by taking the special effect indicated on the special effect indication portion 15 into consideration. Basically, if the sum total value of the fielding side including the operational cards and the special effect is equal to or greater than the sum total value of the batting side, then the fielding side gets over. On the other hand, if the sum total value of the batting side is greater, then the batter makes a hit.

For example, in the case where neither the operational card nor the special effect is used on both sides, it is assumed that the "batting side" has "batting force 7 of the first batter+batting force 5 of a card presented from the hand". Therefore, the sum total value of the batting side becomes "12". On the other hand, the "fielding side" has "fielding force 6 of the starting pitcher+fielding force 5 of a card presented from the hand". Therefore, the sum total value of the fielding side becomes "11". The result value of subtraction thus becomes "+1". When at this time the batting table 13 of the first batter indicates "H" for "+1", then the first batter is considered to make a hit and the running piece 131 is placed on the first base of the baseball field indication portion 140*a*.

If the fielding side has used an operational card, then, for example, the following results. The "batting side" has "batting force 7 of the first batter+batting force 5 of a card presented from the hand". Therefore, the sum total value of the batting side becomes "12". On the other hand, if the "fielding side" uses the win percentage card and turns this card sideways, then the fielding force increases by one. Therefore, because of "fielding force of the starting pitcher 6+fielding force 5 of the card presented from the hand+1 which is an increment of the win percentage card", the sum total of the fielding side becomes "12". The result value of the subtraction becomes "0". If at this tine the batting table 13 of the first batter indicates "strike-out" for "0", the first batter is out and the runner piece 131 is placed on the out count gauge 130*a*.

Subsequently, similar processing is conducted for the second batter. Thus until three outs are achieved (yes of step S814), processing of the steps S802 to 812 is repeated (no of step S814). Upon three outs, the fielding and the batting sides are changed. If cards in the decks 102*a* and 102*b* run out, cards disposed in the dumping places 124*a* and 124*b* are shuffled and disposed on the decks 102*a* and 102*b* again. In this way, the game is advanced. If nine innings are finished, then the game is over (step S816). In the case where a margin becomes equal to or greater than ten before the ninth inning is over, the game may be called off.

In the previous calculation, if the same photograph indication portion 22 is formed on a player card used for the bench. and a player card presented from the hand, the batting force may be increased by one in the case of the batting side as a special combination whereas the fielding force may be increased by one in the case of the fielding side.

Furthermore, it is also possible that the starting pitcher has an ordinary fielding force in the first to fourth innings, but the fielding force is decreased by one per inning in the fifth inning or later. The game maybe advanced so that a reliever pitcher and a closer pitcher may be decreased in fielding force by one per inning from an inning subsequent to an inning in which the pitcher has taken the plate. For example, a starting pitcher having fielding force of 8 may have fielding force of 8 in the first to fourth innings, fielding force of 7 in the fifth inning, fielding force of 6 in the sixth inning, and so on. Furthermore, in the case where a reliever pitcher having fielding force of 6 takes the plate from, the sixth inning, the reliever pitcher may have fielding force of 6 in the sixth inning, fielding force of 5 in the seventh inning, and so on.

Furthermore, if mutual effects overlap when using an operational card and/or a special effect, the effect of the fielding side is made advantageous. For example, it is supposed that a batter makes a sacrifice hit if neither a hit card nor a infield card is used. In such case, if the batting side uses a hit card, the sacrifice hit may be a hit if there is no infield shift card, because of the effect of the hit card. However, if the fielding side uses an infield shift card capable of making the sacrifice hit poor batting, the effect of the fielding side is given priority and the batter is handled as poor batting batter.

An embodiment of the present invention has heretofore been described. In the case where a player card 10 is disposed on the card disposition area (122*a* or 122*b*) of the batting side, the sum total value of batting force indicated by the batting force indication portion 11 of the batter card and batting force indicated by the batting force indication portion 11 of the player card is derived. On the other hand, in the case where a player card 10 is disposed on the card disposition area (122*b* or 122*a*) of the fielding side, the sum total value of fielding force indicated by the fielding force indication portion 12 of the pitcher card and fielding force indicated by the fielding force indication portion 12 of the player card is derived. Subsequently, the game content is determined according to the game advance content indicated in the batting table 13 (game advance content indication portion) of the batter card, for each of subtraction result values obtained by subtracting the sum total value of the fielding side from the sum total value of the batting side. The baseball card game can be thus played. Therefore, it is possible to advance the game while suppressing the number of kinds of cards to the utmost and using the cards evenly. In addition, it is not necessary to determine the game advance content by using a dice or the like.

Heretofore, an embodiment of the present invention has been described. Without departing from the spirit of the present invention, various modifications and changes can be made on the embodiment of the present invention. For example, various modifications and changes, such as suitable changes of layouts of respective portions and suitable changes of layouts of respective areas of the field, can be made.

As heretofore described, the present invention brings about an effect that the baseball game can be advanced while suppressing the number of kinds of cards to the utmost and using respective cards evenly.

What is claimed is:

1. A baseball card game, comprising:

player cards; and a pair of field sheets for disposing the player cards thereon, each of said pair of field sheets including a card disposition area and a pitcher and batter area, one of said pair of field sheets serving as a batting side field and a remaining one of said pair of field sheets serving as a fielding side field at a given time during game play;

said player cards being comprised of various kinds of cards, a batter card and a pitcher card each being one kind of said various kinds of cards, each of the player cards comprising:

a batting force indication portion for giving a sum total value of a batting side when each of the player cards is disposed on the card disposition area of the batting side field, in conjunction with the batter card disposed on the pitcher and batter area of the batting side field;

a fielding force indication portion for giving a sum total value of a fielding side when each of the player cards is disposed on the card disposition area of the fielding side field, in conjunction with the pitcher card disposed on the pitcher and batter area of the fielding side field; and a game advance content indication portion for indicating a game advance content for each of values derived from a comparison made between the sum total value of the batting side and the sum total value of the fielding side.

2. A baseball card game, comprising:

player cards; and a pair of field sheets for disposing the player cards thereon, each of said pair of field sheets including a card disposition area and a pitcher and batter area, one of said pair of field sheets serving as a batting side field and a remaining one of said pair of field sheets serving as a fielding side field at a given time during game play;

said player cards being comprised of various kinds of cards, a batter card and a pitcher card each being one kind of said various kinds of cards, each of the player cards comprising:

a batting force indication portion for giving a sum total value of a batting side when each of the player cards is disposed on the card disposition area of the batting side field, in conjunction with the batter card disposed on the pitcher and batter area of the batting side field;

a fielding force indication portion for giving a sum total value of a fielding side when each of the player cards is disposed on the card disposition area of the fielding side field, in conjunction with the pitcher card disposed on the pitcher and batter area of the fielding side field; and a game advance content indication portion for indicating a game advance content for each of subtraction result values derived by subtracting the sum total value of the fielding side from the sum total value of the batting side.

3. The baseball card game according to claim 1, wherein the pair of the field sheets are formed so as to be opposed to each other and brought into contact with each other.

4. The baseball card game according to claim 1, wherein cards each further comprising a special effect indication portion for indicating a special effect demonstrated in the baseball card game are included in the player cards.

5. The baseball card game according to claim 1, wherein each of the player cards serving as the pitcher card comprises a disposition time indication portion for indicating suitable disposition time of the card.

6. The baseball card game according to claim 1, wherein each of the player cards further comprises:

an image indication portion for indicating a photograph of a professional baseball player; and a result indication portion for indicating actual past results of the professional baseball player.

7. The baseball card game according to claim 1, further comprising operational cards besides the player cards, each of the operational cards comprising an operational content indication portion which indicates an operational content for implementing an advantageous baseball game state including an increase of the fielding force or the batting force.

8. A set of cards for a baseball card game, comprising:

cards including various types, a batter card and a pitcher card each being one of said various types, the baseball card game being played by playing a baseball game while changing a fielding side and a batting side a predetermined number of times, base advance or an out of a batting side being determined in the baseball game by comparing a sum total value of the fielding side with a sum total value of the batting side, the sum total value of the fielding side being a sum total of fielding force of the pitcher card disposed in a first position of a fielding side field and fielding force of a fielding side card disposed in a second position of the fielding side field from a hand of the fielding side, the hand of the fielding side being successively supplemented so as to have a predetermined number of cards by conducting selection from a predetermined number of deck cards piled in a deck position of the fielding side field, the sum total value of the batting side being a sum total of batting force of a batter card disposed in a first position of a batting side field and batting force of a batting side card disposed in a second position of the batting side field from a hand of the batting side, the hand of the batting side being successively supplemented so as to have a predetermined number of cards by conducting selection from a predetermined number of deck cards piled in a deck position of the batting side field;

each of the pitcher card and the fielding side card including a fielding force indication portion for deriving the sum total value of the fielding side;

each of the batter card and the batting side card including a batting force indication portion for deriving the sum total value of the batting side; and a game advance content indication portion for indicating a game advance content for each of values derived from a comparison made between the sum total value of the batting side and the sum total value of the fielding side.

9. The set of cards for a baseball card game according to claim 8, wherein each of the pitcher card and the fielding side card comprises a batting force indication portion for deriving a sum total value of the batting side in case of change between the batting side and the fielding side; and each of the batter card and the batting side card comprises a fielding force indication portion for deriving a sum total value of the fielding side in case of change between the batting side and the fielding side.

10. The set of cards for a baseball card game according to claim 8, wherein cards each further comprising a special effect indication portion for indicating a special effect demonstrated in the baseball card game are included in the cards.

11. A set of cards for a baseball card game, comprising:

cards including various types, a batter card and a pitcher card each being one of said various types, the baseball card game being played by playing a baseball game while changing a fielding side and a batting side a predetermined number of times, base advance or an out of a batting side being determined in the baseball game by comparing a sum total value of the fielding side with a sum total value of the batting side, the sum total value of the fielding side being a sum total of fielding force of the pitcher card disposed in a first position of a fielding side field and fielding force of a fielding side card disposed in a second position of the fielding side field from a hand of the fielding side, the hand of the fielding side being successively supplemented so as to have a predetermined number of cards by conducting selection from a predetermined number of deck cards piled in a deck position of the fielding side field, the sum total value of the batting side being a sum total of batting force of a batter card disposed in a first position of a batting side field and batting force of a batting side card disposed in a second position of the batting side field from a hand of the batting side, the hand of the batting side being successively supplemented so as to have a predetermined number of cards by conducting selection from a predetermined number of deck cards piled in a deck position of the batting side field;

each of the pitcher card and the fielding side card including a fielding force indication portion for deriving the sum total value of the fielding side;

each of the batter card and the batting side card including a batting force indication portion for deriving the sum total value of the batting side; and each of the cards including a game advance content indication portion indicating a game advance content for each of subtraction result values derived by subtracting the sum total value of the fielding side from the sum total value of the batting side.

12. The set of cards for a baseball card game according to claim 8, wherein the cards include operational cards, and each of the operational cards comprises an operational content indication portion which indicates an operational content for implementing an advantageous baseball game state including an increase of fielding force or batting force.

13. The set of cards for a baseball card game according to claim 8, wherein each of the pitcher cards comprises a disposition time indication portion for indicating suitable disposition time of the card.

* * * * *